US009573372B2

(12) United States Patent
Tanaka

(10) Patent No.: US 9,573,372 B2
(45) Date of Patent: Feb. 21, 2017

(54) LIQUID EJECTION APPARATUS AND METHOD FOR MANUFACTURING LIQUID EJECTION APPARATUS

(71) Applicant: BROTHER KOGYO KABUSHIKI KAISHA, Nagoya-shi, Aichi-ken (JP)

(72) Inventor: Taiki Tanaka, Nagoya (JP)

(73) Assignee: BROTHER KOGYO KABUSHIKI KAISHA, Nagoya-shi, Aichi-Ken (JP)

( * ) Notice: Subject to any disclaimer, the term of this patent is extended or adjusted under 35 U.S.C. 154(b) by 0 days.

(21) Appl. No.: 14/951,732

(22) Filed: Nov. 25, 2015

(65) Prior Publication Data

US 2016/0152028 A1 Jun. 2, 2016

(30) Foreign Application Priority Data

Dec. 1, 2014 (JP) ..... 2014-242978

(51) Int. Cl.
*B41J 2/045* (2006.01)
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1628* (2013.01); *B41J 2/1629* (2013.01); *B41J 2/1631* (2013.01); *B41J 2002/14241* (2013.01)

(58) Field of Classification Search
CPC B41J 2/14233; B41J 2/14201; B41J 2/14241; B41J 2/161; B41J 2/1628; B41J 2/1629; B41J 2/1631
See application file for complete search history.

(56) References Cited

U.S. PATENT DOCUMENTS 7,239,070 B2 * 7/2007 Shimada ..... B41J 2/14233 310/328

FOREIGN PATENT DOCUMENTS

JP 2006-123518 A 5/2006

* cited by examiner

*Primary Examiner* — Juanita D Jackson
(74) *Attorney, Agent, or Firm* — Merchant & Gould P.C.

(57) ABSTRACT

A liquid ejection apparatus and method of manufacture are disclosed. One apparatus includes a piezoelectric element corresponding to a pressure chamber in a channel substrate, a trace corresponding to the piezoelectric element. The piezoelectric element includes a piezoelectric layer, a first electrode, a second electrode disposed on a surface of the piezoelectric layer on a side opposite the channel substrate, and a protective film covering the piezoelectric layer and the second electrode. The second electrode includes a lead-out portion that extends to an area over the channel substrate where the piezoelectric layer is not disposed, and a contact portion that is provided in the lead-out portion and that is exposed from the protective film in the area. The trace is connected to the second electrode at the exposed contact portion.

15 Claims, 14 Drawing Sheets

LIQUID EJECTION APPARATUS AND METHOD FOR MANUFACTURING LIQUID EJECTION APPARATUS

CROSS-REFERENCE TO RELATED APPLICATION

This application claims priority from Japanese Patent Application No. 2014-242978 filed on Dec. 1, 2014, which is incorporated herein by reference in its entirety.

BACKGROUND

1. Technical Field

The present disclosure relates to a liquid ejection apparatus that ejects a liquid and a method for manufacturing the liquid ejection apparatus.

2. Description of the Related Art

Japanese Unexamined Patent Application Publication No. 2006-123518 discloses, as a liquid ejection apparatus, an inkjet head that records an image and the like by discharging ink onto a recording medium. The inkjet head of Japanese Unexamined Patent Application Publication No. 2006-123518 includes a channel defining substrate in which a plurality of pressure chambers are formed and a piezoelectric actuator provided in a diaphragm of the channel defining substrate that covers the plurality of pressure chambers.

The piezoelectric actuator includes a plurality of piezoelectric elements that are disposed on the diaphragm so as to correspond to the plurality of pressure chambers. Each piezoelectric element includes a piezoelectric portion (a piezoelectric layer) formed of lead zirconate titanate, a lower electrode that is formed of platinum and iridium and that is disposed on a lower side of the piezoelectric portion, and an upper electrode that is formed of iridium and that is disposed on an upper side of the piezoelectric portion. A first lead electrode formed of aluminum is connected to an end portion of the upper electrode that is positioned on an upper surface of the piezoelectric portion. The first lead electrode is drawn out from the upper surface of the piezoelectric portion to above the diaphragm, and is extended along a surface of the diaphragm. Furthermore, the piezoelectric portion, the upper electrode, and the first lead electrode are commonly covered by a protective film formed of aluminum oxide. Furthermore, a second lead electrode formed of gold is formed on the protective film. Furthermore, the first lead electrode is connected to the second lead electrode on the protective film at a position away from the piezoelectric element through a contact hole formed in the protective film.

The piezoelectric actuator described above is manufactured by repeating deposition and patterning and by sequentially stacking each of the various films, such as the piezoelectric portion and various electrodes, on the diaphragm that covers the plurality of pressure chambers of the channel defining substrate. First, the lower electrode, the piezoelectric portion, and the upper electrode of each piezoelectric element are formed on the diaphragm in that order. Next, the first lead electrode that is connected to the upper electrode and that extends from the upper surface of the piezoelectric portion to the upper surface of the diaphragm is formed. Each first lead electrode is formed by depositing a metal film and then patterning the metal film. Next, the protective film is formed so as to cover the piezoelectric portion, the upper electrode, and the first lead electrode. Furthermore, patterning of the protective film is performed and a contact hole is formed in a portion of the protective film covering a terminal of the first lead electrode. Last of all, the second lead electrode is formed on the protective film and, at this point, the second lead electrode is brought in contact with the terminal of the first lead electrode through the contact hole.

SUMMARY

In Japanese Unexamined Patent Application Publication No. 2006-123518 described above, the protective film not only covers the piezoelectric portion and the upper electrode, but also covers the trace (the first lead electrode) that is connected to the upper electrode. In other words, the trace is directly provided on the surface of the piezoelectric portion. In such a case, problems described below may disadvantageously occur.

(1) When the trace is formed, the piezoelectric portion and the upper electrode are not covered by the protective film. Accordingly, when patterning the trace by etching, the piezoelectric portion and the upper electrode may be scraped away and the film thicknesses may disadvantageously become thin. Furthermore, with hydrogen and the like that is contained in the etching solution for performing etching, the piezoelectric portion that is an oxide may be disadvantageously damaged such as being reduced.

(2) When a wire formed of metal such as aluminum is provided in direct contact with the piezoelectric portion, which is an oxide, transfer of electrons occur between the piezoelectric portion and the trace. With the above, oxygen atom of the piezoelectric portion is deprived and the piezoelectric portion is reduced causing an oxygen defect in the piezoelectric portion. The oxygen defect may disadvantageously cause a dielectric breakdown in the piezoelectric portion.

(3) In order to lower the electric resistance, it is desirable that the trace has a certain thickness or more. However, as is the case of Japanese Unexamined Patent Application Publication No. 2006-123518, when a configuration in which the trace with a certain thickness is connected on the upper electrode is employed, unevenness occurs at the portion where the upper electrode and the trace overlap each other. Accordingly, when forming the protective film after the trace has been formed, the material forming the protective film does not easily deposit in the vicinity of the uneven portion and the thickness of the protective film becomes partially thin. Accordingly, it is desirable that the protective film is deposited on a surface that is in a state in which no trace is formed and that is as flat as possible.

As described above, various problems may be encountered in the configuration of Japanese Unexamined Patent Application Publication No. 2006-123518. Accordingly, as illustrated in FIG. 14, it is preferable that, after an upper electrode 133 is formed on a piezoelectric portion 132 and after the piezoelectric portion 132 and the electrode 133 are covered by a protective film 134, a trace 135 (corresponding to the first lead electrode of Japanese Unexamined Patent Application Publication No. 2006-123518: illustrated by a two-dot chain line) is formed on the protective film 134. However, in the above case, in order to connect the upper electrode 133 and the trace 135 to each other on an upper surface of the piezoelectric portion 132, a contact hole **134*a* needs to be formed in the protective film 134. Specifically, the contact hole 134*a* is formed in the protective film 134 by etching after a resist mask 137 has been formed on the protective film 134. During the etching of the protective film 134, the piezoelectric portion 132 that is exposed from the protective film 134 at the position of the contact hole 134*a* may be disadvantageously damaged. For example, due to the reducing material, such as hydrogen, contained in the etching solution, at the position of the contact hole 140, the piezoelectric portion 132 that is exposed from the protective film 134** is reduced.

An object of the present disclosure is to fabricate a configuration that is capable of connecting an electrode that is provided on an upper surface of a piezoelectric layer to a trace without removing a protective film covering the piezoelectric layer.

According to an aspect of disclosure, a liquid ejection apparatus includes a piezoelectric element corresponding to a pressure chamber in a channel substrate; and a trace corresponding to the piezoelectric element. The piezoelectric element includes a piezoelectric layer, a first electrode disposed on a surface of the piezoelectric layer on a channel substrate side, and a second electrode disposed on a surface of the piezoelectric layer on a side opposite the channel substrate. A protective film covers the piezoelectric layer and the second electrode. The second electrode includes a lead-out portion that extends from the surface of the piezoelectric layer on the side opposite the channel substrate, along a lateral surface of the piezoelectric layer, and to an area over the channel substrate where the piezoelectric layer is not disposed, and a contact portion that is provided in the lead-out portion and that is exposed from the protective film in the area over the channel substrate where the piezoelectric layer is not disposed. The Trace is connected to the corresponding second electrode at the exposed contact portion.

In the present aspect of the disclosure, since the contact portion of the second electrode is drawn out to area of the channel substrate where no piezoelectric layer is disposed, when connecting the second electrode and the trace to each other, there is no need to remove the area of the protective film covering the piezoelectric layer by etching so as to expose the piezoelectric layer from the protective film. Accordingly, the piezoelectric layer does not receive any damage during etching of the protective film or during the following processes such as the process of forming the trace.

BRIEF DESCRIPTION OF THE DRAWINGS

FIGS. 6A to 6F are diagrams for describing a manufacturing process of the inkjet head in which FIG. 6A illustrates a diaphragm deposition process, FIG. 6B illustrates a diaphragm etching process, FIG. 6C illustrates a lower electrode forming process, FIG. 6D illustrates a piezoelectric portion forming process, FIG. 6E illustrates a deposition process of a conductive film for the upper electrode, and FIG. 6F illustrates an upper electrode patterning process.

FIGS. 7A to 7D are diagrams for describing a manufacturing process of the inkjet head in which FIG. 7A illustrates a protective film deposition process, FIG. 7B illustrates a protective film etching process, FIG. 7C illustrates an insulation film deposition process, and FIG. 7D illustrates an insulation film etching process.

FIGS. 8A and 8B are diagrams for describing a manufacturing process of the inkjet head in which FIG. 8A illustrates a trace forming process and FIG. 8B illustrates a trace protecting film forming process.

FIGS. 9A to 9C are diagrams for describing a manufacturing process of the inkjet head in which FIG. 9A illustrates an etching process of the channel substrate, FIG. 9B illustrates a nozzle plate joining process, and FIG. 9C illustrates a reservoir defining member joining process.

FIGS. 11A to 11H are diagrams for describing a manufacturing process of the piezoelectric actuator in FIG. 10 in which FIG. 11A illustrates a lower electrode forming process, FIG. 11B illustrates an insulation film forming process, FIG. 11C illustrates a piezoelectric portion forming process, FIG. 11D illustrates an upper electrode forming process, FIG. 11E illustrates a protective film forming process, FIG. 11F illustrates an insulation film forming process, FIG. 11G illustrates a trace forming process, and FIG. 11H illustrates a trace protecting film forming process.

DESCRIPTION OF THE PREFERRED EMBODIMENTS

Figure 1:
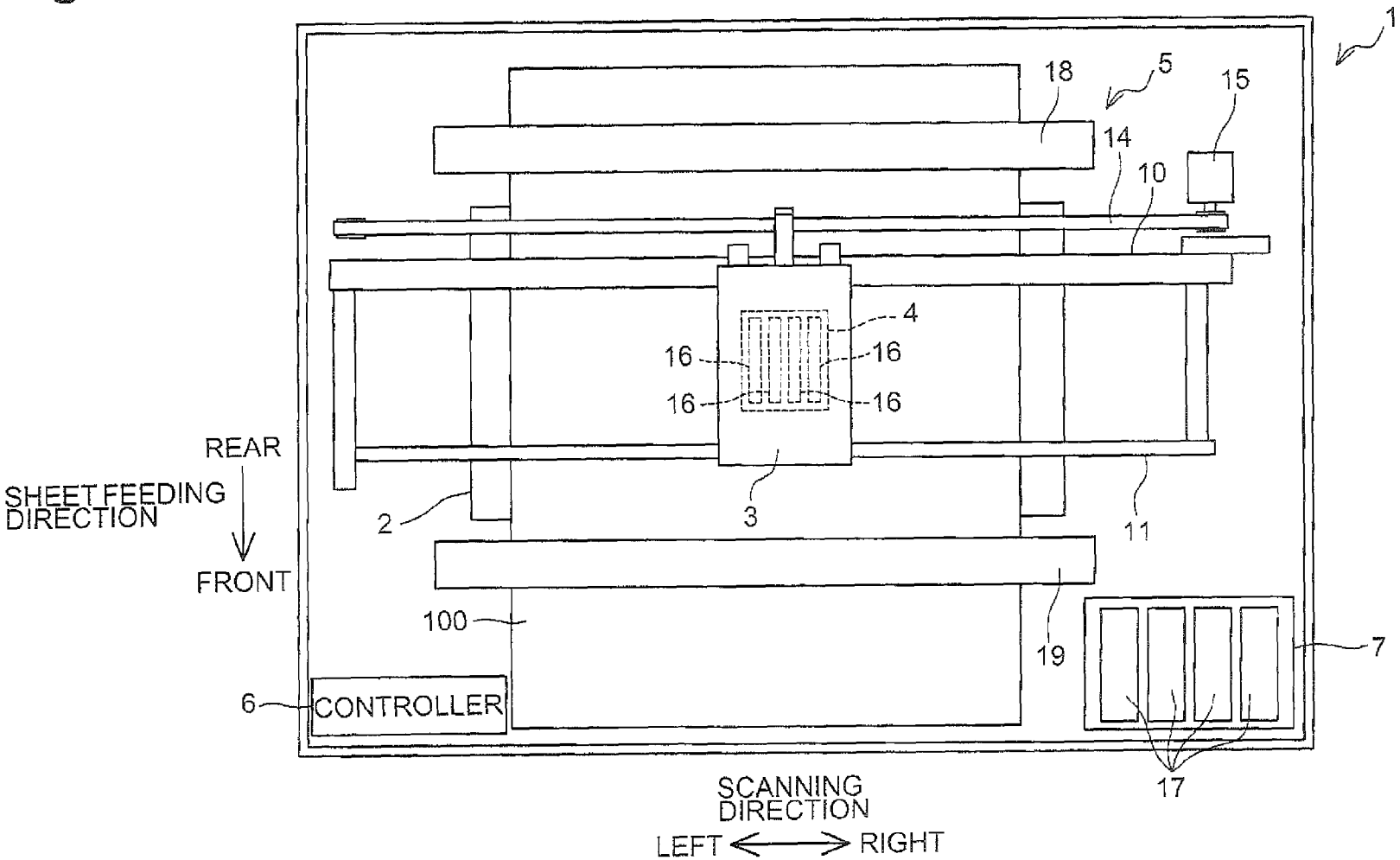
FIG. 1 is a schematic plan view of a printer according to the present exemplary embodiment.

An exemplary embodiment of the present disclosure will be described next. FIG. 1 is a schematic plan view of a printer according to the present exemplary embodiment. Referring to FIG. 1, a schematic configuration of an inkjet printer 1 will be described first. Note that front, rear, left, and right directions illustrated in FIG. 1 defines the "front", "rear", "left", and "right" of the printer, respectively. Furthermore, this side of the paper is defined as the "up" side and that side of the paper is defined as the "down" side. Hereinafter, the description will be given using, as required, each of the directional terms such as front, rear, left, right, up, and down.

Schematic Configuration of Printer

As illustrated in FIG. 1, the inkjet printer 1 includes a platen 2, a carriage 3, an inkjet head 4, a transport mechanism 5, and a controller 6.

A piece of recording sheet 100 (e.g., paper) that is a recording medium is placed on an upper surface of the platen 2. The carriage 3 is configured so as to be capable of reciprocating in a left-right direction (hereinafter, also referred to as a scanning direction) along two guide rails 10 and 11 in the area opposing the platen 2. The carriage 3 is connected to an endless belt 14, and the endless belt 14 driven by a carriage drive motor 15 moves the carriage 3 in the scanning direction.

The inkjet head 4 is attached to the carriage 3 and moves in the scanning direction together with the carriage 3. The inkjet head 4 includes four head units 16 aligned in the scanning direction. The four head units 16 are connected to a cartridge holder 7, on which ink cartridges 17 of four colors (black, yellow, cyan, and magenta) are mounted, by tubes (not shown). Each of the head units 16 includes a plurality of nozzles 24 (see FIGS. 2 to 4) formed on an undersurface (a surface on that side of the paper of FIG. 1). The nozzles 24 of each of the head units 16 eject ink that has been supplied from the corresponding ink cartridge 17 towards the recording sheet 100 placed on the platen 2.

The transport mechanism 5 includes two transport rollers 18 and 19 that are disposed in the front and rear direction so as to interpose the platen 2 therebetween. The transport mechanism 5 transports the recording sheet 100 that is placed on the platen 2 towards the front (hereinafter, also referred to as a transport direction) with the two transport rollers 18 and 19.

The controller 6 includes a read-only memory (ROM), a random-access memory (RAM), and an application specific integrated circuit (ASIC) including various control circuits. The controller 6 executes various processes such as printing on the recording sheet 100 through the ASIC in accordance with the program stored in the ROM. For example, in the printing process, the controller 6 controls the inkjet head 4, the carriage drive motor 15, and the like and prints an image and the like on the recording sheet 100 on the basis of the print command input from an external device such as a personal computer. Specifically, an ink ejection operation, which ejects ink while moving the carriage 3 together with the inkjet head 4 in the scanning direction, and a transport operation, which transports the recording sheet 100 a predetermined amount with the transport rollers 18 and 19, are performed alternately.

Detail of Inkjet Head

Figure 2:
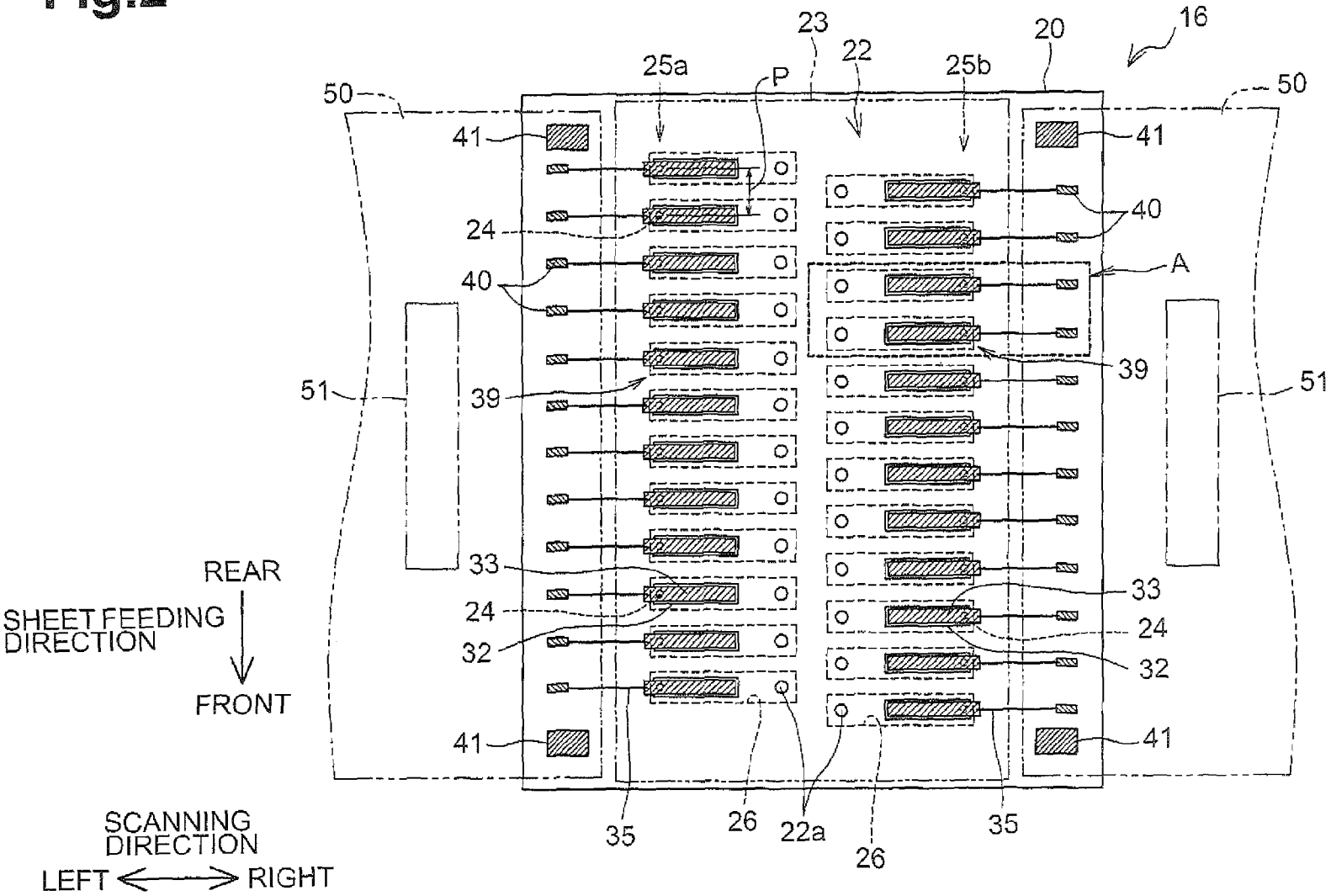
FIG. 2 is a top view of a head unit of the inkjet head.
Figure 3:
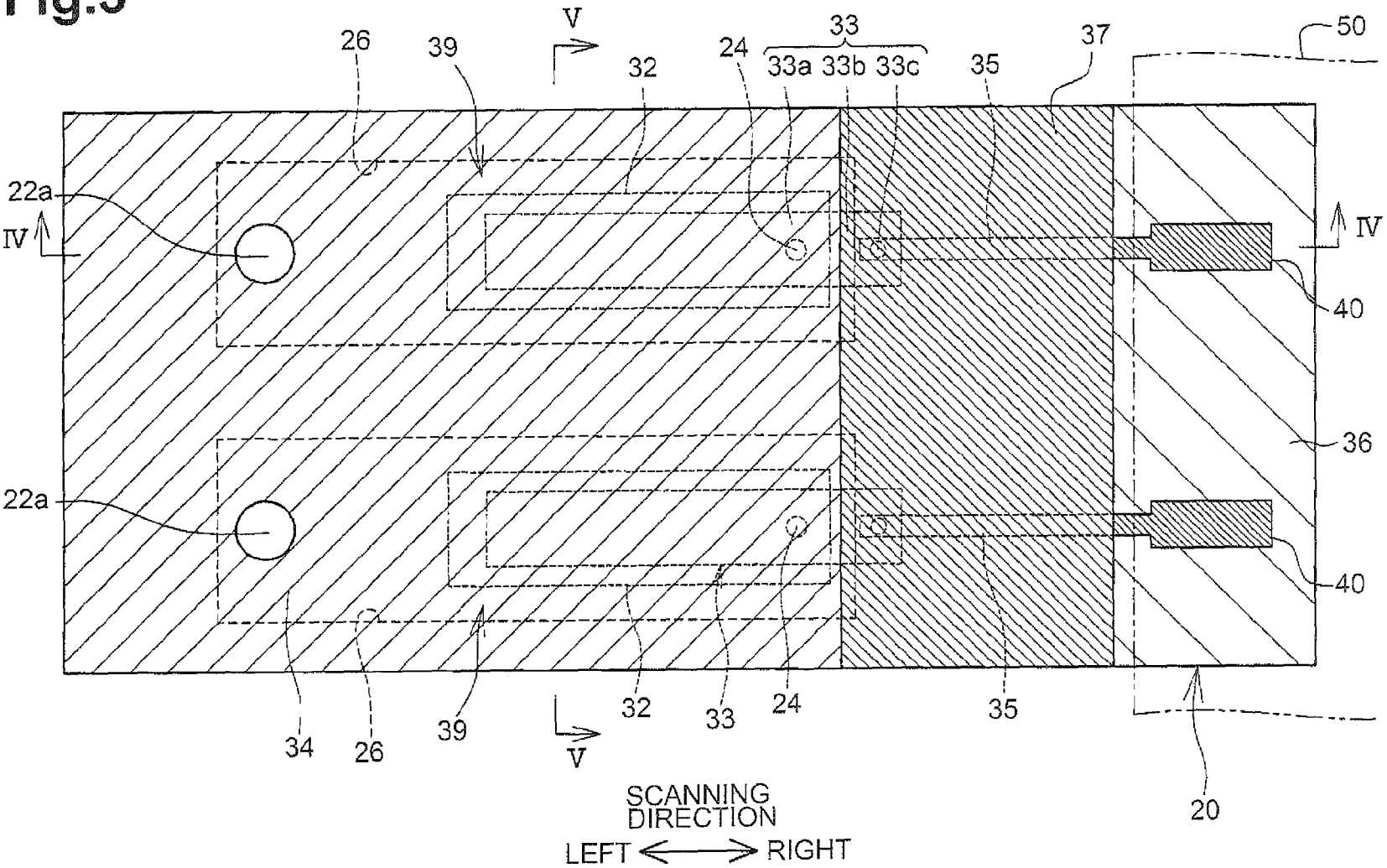
FIG. 3 is an enlarged view of a portion A of FIG. 2.
Figure 4:
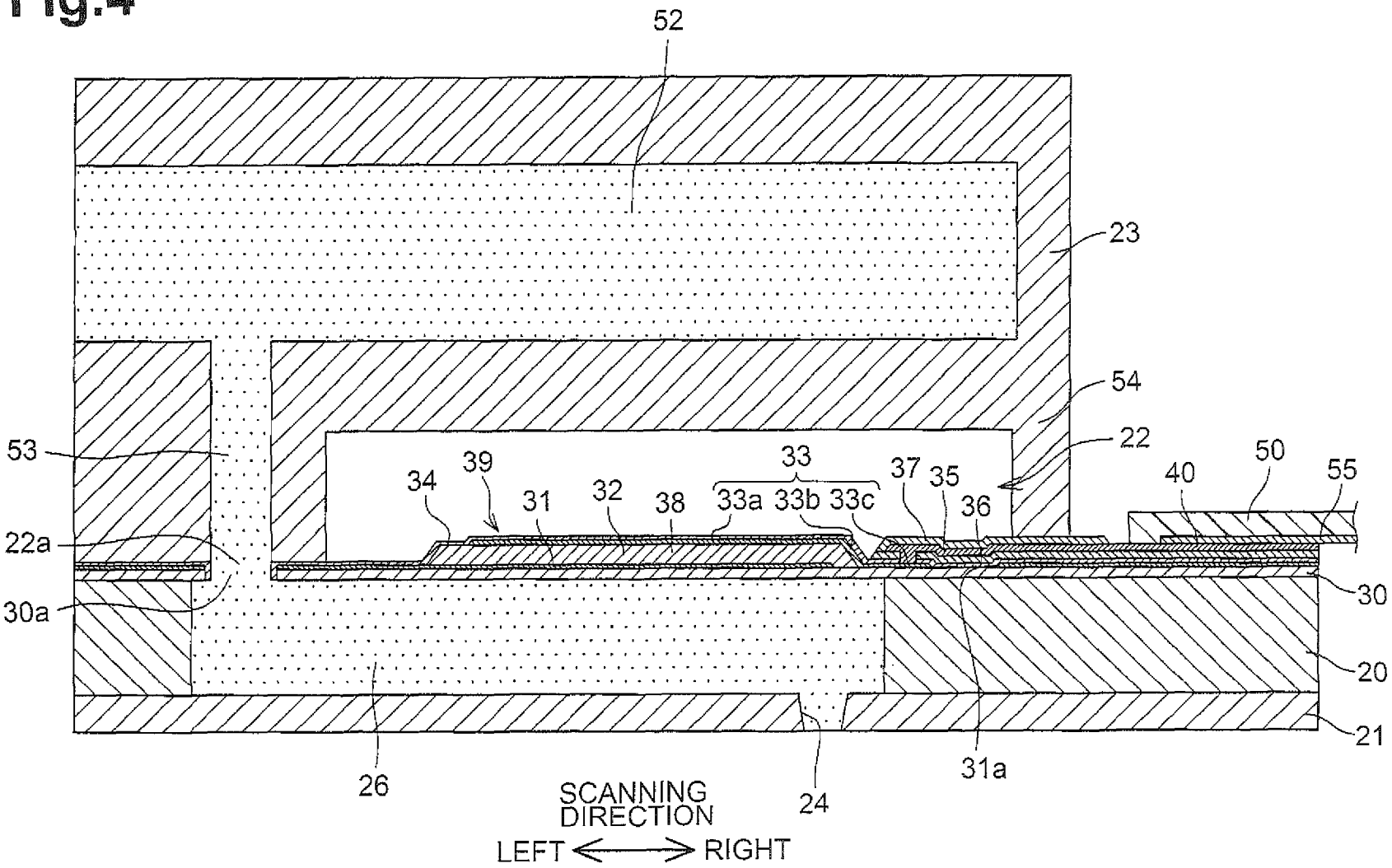
FIG. 4 is a cross-sectional view taken along line IV-IV of FIG. 3.
Figure 5:
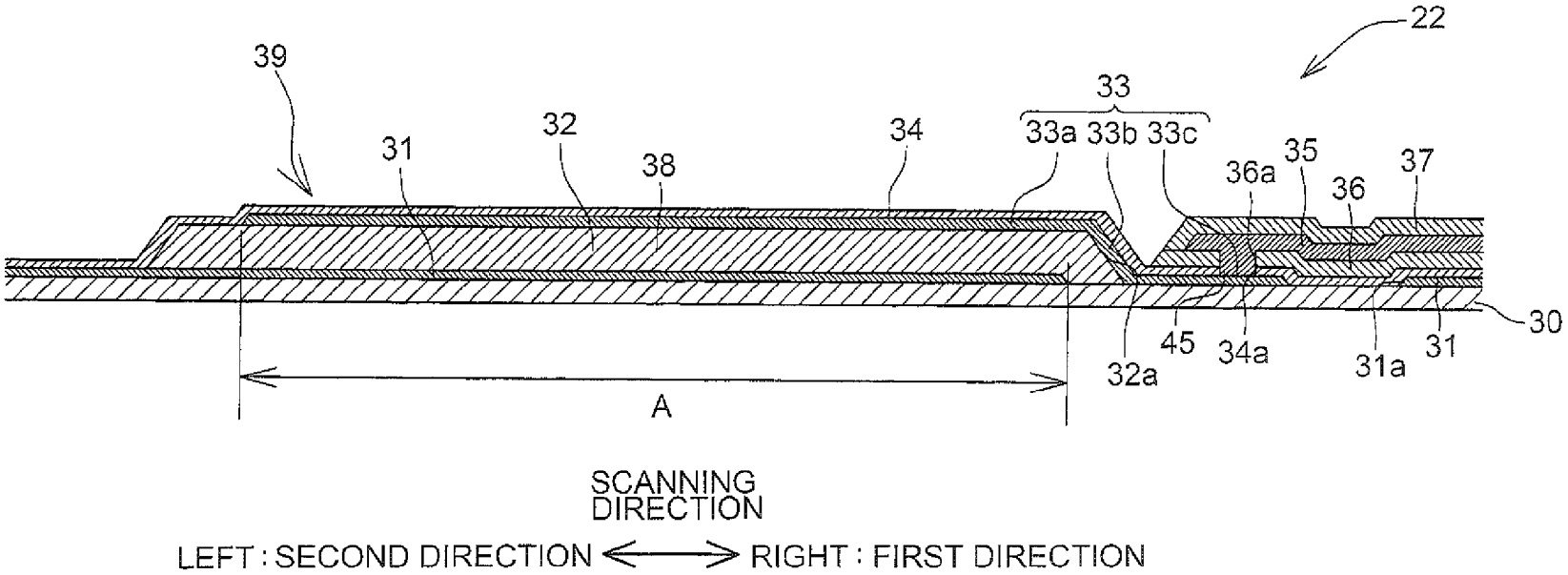
FIG. 5 is an enlarged cross-sectional view of a piezoelectric actuator of FIG. 4.

A detailed configuration of the inkjet head 4 will be described next. FIG. 2 is a top view of one of the head units 16 of the inkjet head 4. Note that the four head units 16 of the inkjet head 4 are all configured in the same manner; accordingly, one among the four will be described and description of the other head units 16 will be omitted. FIG. 3 is an enlarged view of a portion A of FIG. 2. FIG. 4 is a cross-sectional view taken along line IV-IV of FIG. 3. FIG. 5 is an enlarged view of a piezoelectric actuator of FIG. 4.

As illustrated in FIGS. 2 to 5, the head unit 16 includes a channel substrate 20, a nozzle plate 21, piezoelectric actuator 22, and a reservoir defining member 23. Note that in FIG. 2, in order to simplify the drawing, only the external form of the reservoir defining member 23 that is positioned above the channel substrate 20 and the piezoelectric actuator 22 is illustrated with a two-dot chain line.

Channel Substrate

The channel substrate 20 is a silicon single crystal substrate. A plurality of pressure chambers 26 are formed in the channel substrate 20. As illustrated in FIGS. 2 and 3, each of the pressure chambers 26 has a planar rectangular shape that is long in the scanning direction. The plurality of pressure chambers 26 are arranged in the transport direction and configure two pressure chamber rows that are arranged in the scanning direction. Furthermore, the channel substrate 20 includes a diaphragm 30 that covers the plurality of pressure chambers 26. The diaphragm 30 is a film formed of silicon dioxide ($SiO_2$) or silicon nitride (SiNx) that is formed by oxidizing or nitriding a portion of the silicon channel substrate 20. Furthermore, a plurality of communication holes 30*a* that communicate the channels inside the reservoir defining member 23 described later and the plurality of pressure chambers 26 with each other are formed in the diaphragm 30.

Nozzle Plate

The nozzle plate 21 is joined to an undersurface of the channel substrate 20. The plurality of nozzles 24 that are each in communication with the corresponding one of the plurality of pressure chambers 26 of the channel substrate 20 are formed in the nozzle plate 21. As illustrated in FIG. 2, similar to the plurality of pressure chambers 26, the plurality of nozzles 24 are arranged in the transport direction and configure two lines of nozzle rows 25*a* and 25*b* that are arranged in the scanning direction. Between the two lines of nozzle rows 25*a* and 25*b*, the positions of the nozzles 24 in the transport direction are offset by half of a pitch P (P/2) in which the nozzles 24 are arranged in the nozzle rows 25. Note that the material of the nozzle plate 21 is not limited in particular. For example, various materials may be employed such as a metal material such as stainless steel, silicon, or a synthetic resin such as polyimide.

Piezoelectric Actuator

The piezoelectric actuator 22 is configured to apply ejection energy to the ink in the pressure chambers 26 so as to allow the ink to be ejected through the nozzles 24. The piezoelectric actuator 22 is disposed on an upper surface of the diaphragm 30 of the channel substrate 20. As illustrated in FIG. 2 to FIG. 5, the piezoelectric actuator 22 on the upper surface of the diaphragm 30 includes a plurality of piezoelectric elements 39 disposed so as to correspond to the pressure chambers 26, which are arranged in two rows, and a plurality of traces 35 corresponding to the piezoelectric elements 39, for example.

Furthermore, communication holes 22*a* that are in communication with the communication holes 30*a* of the diaphragm 30 are formed in the piezoelectric actuator 22. Note that in FIG. 2, in order to simplify the drawing, illustration of portions of the configuration illustrated in FIGS. 3 and 4, for example, a protective film 34 that covers piezoelectric portions 32, and trace protecting films 37 that cover the traces 35, are omitted.

Hereinafter, a configuration of the piezoelectric elements 39 of the piezoelectric actuator 22 and configurations associated therewith will be described in detail. First, the piezoelectric elements 39 each include a lower electrode 31, the piezoelectric portion 32, an upper electrode 33, and the protective film 34.

The lower electrode 31 is formed on substantially the entire area of the upper surface of the diaphragm 30 so as to extend across the plurality of pressure chambers 26. The lower electrode 31 is a common electrode for the piezoelectric elements 39. It can be said that the lower electrode 31 is an integrated structure in which a plurality of electrodes that are formed so as to each oppose the corresponding one of the plurality of pressure chambers 26 are conducted to each other on the upper surface of the diaphragm 30. As illustrated in FIGS. 4 and 5, hole 31*a* is formed in the lower electrode 31 in the vicinity of the end portion of the pressure chamber 26 that is on the opposite side with respect to the communication hole 30*a* of the diaphragm 30. In the area of the hole 31*a*, the lower electrode 31 is not formed locally. A contact portion 33*c* of the upper electrode 33 described later is disposed in hole 31*a* of the lower electrode 31. Note that the material of the lower electrode 31 is not limited to a particular material; however, the lower electrode 31 is formed of platinum (Pt), for example.

The piezoelectric portions 32 of the piezoelectric elements 39 are disposed on the lower electrode 31. As illustrated in FIG. 3, each of the piezoelectric portions 32 has a planar rectangular shape that is a size smaller than the pressure chambers 26 and that is long in the scanning direction. Each piezoelectric portion 32 is disposed so as to oppose the center portion of the corresponding pressure chamber 26. The piezoelectric portions 32 are each formed of, for example, a piezoelectric body in which the main component is lead zirconate titanate (PZT) that is a mixed crystal of lead titanate and lead zirconate. Alternatively, the piezoelectric portions 32 may be formed of a non-lead-based piezoelectric material containing no lead. The piezoelectric portions 32 are each formed so as to have a tapered shape in which an area of an upper surface is smaller than an area of an undersurface.

Note that in FIGS. 2 and 3, the exemplary embodiment is illustrated such that the plurality of piezoelectric portions 32 corresponding to a single pressure chamber row are separated from each other; however, the plurality of piezoelectric portions 32 may be connected to each other. Furthermore, in such a case, slits may be formed at positions between piezoelectric portions 32, that is, the piezoelectric material layer that is integrally formed by the plurality of piezoelectric portions 32.

The upper electrodes 33 are disposed on the upper sides of the piezoelectric portions 32. The upper electrodes 33 are each a discrete electrode that is individually provided on the piezoelectric portion 32 of the corresponding piezoelectric element 39. The upper electrodes 33 are each formed of platinum (Pt) or iridium (Ir), for example. Furthermore, each upper electrode 33 extends from an upper surface of the corresponding piezoelectric portion 32, passes through the lateral surface of the corresponding piezoelectric portion 32, and reaches the upper surface of the diaphragm 30 (to the area of the holes 31*a*) where the lower electrode 31 is not formed locally.

More specifically, the upper electrodes 33 each include a main electrode portion 33*a*, a lead-out portion 33*b*, and the contact portion 33*c*. Each main electrode portion 33*a* is disposed at the center portion of the upper surface of the corresponding piezoelectric portion 32. Furthermore, each main electrode portion 33*a* has a planar rectangular shape that is a size smaller than the piezoelectric portion 32 and that is long in the scanning direction. Each lead-out portion 33*b* is drawn out to the outer side in the scanning direction from the upper surface of the corresponding piezoelectric portion 32, extends along a lateral surface of the corresponding piezoelectric portion 32, and further extends to the area of the diaphragm 30 where the piezoelectric portion 32 is not disposed. Each contact portion 33*c* is provided at a tip of the corresponding lead-out portion 33*b*. Furthermore, as illustrated in FIGS. 3 to 5, each contact portion 33*c* is disposed on the diaphragm 30 that is outside the portion where the diaphragm 30 covers the pressure chamber 26.

As described above, the lateral surface of each piezoelectric portion 32 is an inclined surface that inclines more to the inside as the inclined surface is farther away from the diaphragm 30. Accordingly, the lead-out portions 33*b* of the upper electrodes 33 can be reliably deposited on lateral surfaces 32*a* on the outer sides of the piezoelectric portions 32 in the scanning direction, and a disconnection in the lead-out portions 33*b* can be prevented. In some embodiments, the lateral surface forms an acute angle, for example of about 45 to 60 degrees relative to a surface on the channel substrate side of the piezoelectric portion 32.

The piezoelectric portions 32 described above are interposed between the lower electrode 31 that is disposed on a lower side (on the channel substrate 20 side) and the upper electrodes 33 that are disposed on an upper side (on the side opposite to the channel substrate 20). The portions of the piezoelectric portions 32 that are interposed between the upper electrodes 33 and the lower electrode 31 are, hereinafter, referred to as active portions 38 in particular. Furthermore, the active portions 38 of the piezoelectric portions 32 are polarized downwards in a thickness direction, in other words, in a direction oriented from the upper electrodes 33 towards the lower electrode 31.

As illustrated in FIG. 5, note that a range (an active area A) of each active portion 38 of the piezoelectric portion 32 in the scanning direction is defined by edge positions of the corresponding upper electrode 33 and lower electrode 31 in the scanning direction. Regarding the right direction in FIG. 5, the lead-out portions 33*b* of the upper electrodes 33 are drawn out to the right side from the upper surfaces of the piezoelectric portions 32. The right ends of the lower electrode 31 are positioned inside (on the left side of) the right ends of the upper electrodes 33 and inside (on the left side of) the right ends of the piezoelectric portions 32. Note that the right direction in FIG. 5 is the drawing out direction of the lead-out portions 33*b*, in other words, the right direction in FIG. 5 is a "first direction" of the present disclosure. Furthermore, regarding the left direction in FIG. 5 (a direction opposite to the drawing out direction), the lower electrode 31 is drawn out to the left side with respect to the piezoelectric portions 32. The left ends of the upper electrodes 33 are positioned inside (on the right side of) the left ends of the lower electrode 31 and inside (on the right side of) the left ends of the piezoelectric portions 32. Note that the left direction in FIG. 5 is a direction opposite to the drawing out direction of the lead-out portions 33*b*, in other words, the left direction in FIG. 5 is a "second direction" of the present disclosure.

With the above, the right end of each active portion 38 is defined by the position of the corresponding right end of the lower electrode 31, and the left end of each active portion 38 is defined by the position of the left end of the corresponding upper electrode 33. In the above configuration, during manufacturing the piezoelectric actuator 22, when the position where the lower electrode 31 is formed is deviated in a left-right direction, the active areas A in which the upper electrodes 33 and the lower electrode 31 overlap each other change. The active portions 38 that are formed of piezoelectric materials that are interposed between the upper electrodes 33 and the lower electrode 31 are similar to a capacitive component (a so-called condenser) that has a certain amount of electrostatic capacity. Accordingly, when the areas A in which the upper electrodes 33 and the lower electrode 31 overlap each other change due to the left or right deviation in the position where the lower electrode 31 is formed, the electrostatic capacities of the active portions 38 change as well. The electrostatic capacities of the active portions 38 have a great effect on the responsiveness of the deformation of the piezoelectric portions 32 when a predetermined voltage is applied across the upper electrodes 33 and the lower electrode 31 and, consequently, have a great effect on the ejection characteristics of the ink from the nozzles 24. Accordingly, it is desirable that the changes in the electrostatic capacities of the active portions 38 are suppressed to the smallest extent possible when the positions of the lower electrode 31 are deviated.

Now, in the present exemplary embodiment, the lead-out portions 33*b* of the upper electrodes 33 are formed on the right lateral surfaces 32*a* that are inclinations of the piezoelectric portions 32. When the right ends of the lower electrode 31 are positioned in the areas overlapping the inclined lateral surfaces 32*a*, the changes in the capacities of the active portions 38 disadvantageously becomes large when there is a small deviation in the position of the lower electrode 31. Accordingly, as illustrated in FIG. 5, each of the right ends of the lower electrode 31 is positioned in an area on the left side with respect to the inclined right lateral surface 32*a* of the corresponding piezoelectric portion 32 and in an area that does not overlap the right lateral surface 32*a* in the thickness direction of the piezoelectric portion 32.

A relationship between the positions of the ends of the lower electrode 31 and the inclined lateral surfaces 32*a* of the piezoelectric portions 32 will be described in further detail. When C is an electrostatic capacity of the active portion 38, S is an area of the active portion 38, d is an inter-electrode distance between the upper electrode 33 and the lower electrode 31, and ∈ is a dielectric constant of the active portions 38, expression C=∈S/d is obtained.

(1) As illustrated in FIG. 5, when the right end of the lower electrode 31 does not overlap the right lateral surface 32*a* of the piezoelectric portion, the area S of the active portion 38 changes when the position of the lower electrode 31 is deviated to the left or right, and C also changes. However, the inter-electrode distance d does not change.

(2) Conversely, when the right end of the lower electrode 31 overlaps the right lateral surface 32*a* of the piezoelectric portion 32, the area S of the active portion 38 changes when the position of the lower electrode 31 is deviated to the left or right, and, further, the inter-electrode distance d at the right end portion of the piezoelectric portion 32 changes as well.

Specifically, when the position of the lower electrode 31 deviates to the right side, S becomes larger and d becomes smaller at the right end portion of the piezoelectric portion 32. The area S becoming larger increases C and, further, compared with the case of (1), the increasing amount of C becomes larger in accordance with the decrease in d at a portion of the active portion 38. Furthermore, when the position of the lower electrode 31 deviates to the left side, S becomes smaller and d becomes larger at the right end portion of the piezoelectric portion 32. With the above, S becoming smaller reduces C and, further, compared with the case of (1), the decreasing amount of C becomes larger in accordance with the increase in d at a portion of the active portion 38.

Furthermore, when the right end of the lower electrode 31 overlaps the inclined right lateral surface 32*a* of the piezoelectric portion 32, the inter-electrode distance d between the right end portion of the lower electrode 31 and the upper electrode 33 becomes small. From the viewpoint of suppressing the dielectric breakdown of the piezoelectric portion 32 between the lower electrode 31 and the upper electrode 33, desirably, the right end of the lower electrode 31 does not overlap the right lateral surface 32*a* of the piezoelectric portion 32.

As illustrated in FIGS. 3 to 5, the protective film 34 is disposed so as to cover the piezoelectric portions 32 and the upper electrodes 33 of the piezoelectric elements 39. As illustrated in FIG. 3, note that in the present exemplary embodiment, although the protective film 34 of the piezoelectric elements 39 is connected as an integrated film that covers substantially the whole area of the diaphragm 30, the protective film 34 may be separated between the plurality of piezoelectric elements 39. An object of providing the protective film 34 is to prevent moisture included in the air from penetrating into the piezoelectric portions 32. Furthermore, prevention of the piezoelectric portions 32 from becoming damaged in a process after the piezoelectric portions 32 are formed is another object. The protective film 34 is formed of an oxide such as alumina ($Al_2O_3$), silicon oxide (SiOx), or tantalum oxide (TaOx) or a nitride such as silicon nitride (SiN), for example.

As illustrated in FIGS. 3 to 5, an insulation film 36 is formed on the protective film 34 of the piezoelectric elements 39. The material of the insulation film 36 is not limited to a particular material; however, the insulation film 36 is formed of silicon dioxide ($SiO_2$), for example. The insulation film 36 is provided so as to increase the insulation between the traces 35 described next that is connected to the upper electrodes 33 and the lower electrode 31.

Note that as illustrated above, the lead-out portion 33*b* of the upper electrode 33 is drawn out from the main electrode portion 33*a* to the area of the upper surface of the diaphragm 30 in which no piezoelectric portion 32 is disposed, and the contact portion 33*c* is provided at the tips of the lead-out portions 33*b*. Furthermore, contact holes 34*a* and 36*a* are formed in portions of the protective film 34 and the insulation film 36, respectively, where the contact portions 33*c* are disposed. With the contact holes 34*a* and 36*a*, the contact portions 33*c* of the upper electrodes 33 are exposed from the protective film 34 and the insulation film 36.

The plurality of traces 35 corresponding to the plurality of piezoelectric elements 39 are formed on the insulation film 36. The traces 35 are each formed of aluminum (Al) or gold (Au). As illustrated in FIGS. 3 to 5, one end of each of the traces 35 is connected to the contact portion 33*c* of the corresponding upper electrode 33 with conduction portions 45 filled inside the corresponding contact hole 34*a* of the protective film 34 and the contact hole 36*a* of the corresponding insulation film 36. Furthermore, the traces 35 extend in the scanning direction along the upper surface of the diaphragm 30 from the contact portions 33*c*. More specifically, as illustrated in FIG. 2, the traces 35 that are connected to the upper electrodes 33 that are arranged on the left side extend to the left side from the contact portions 33*c* of the upper electrodes 33, and the traces 35 that are connected to the upper electrodes 33 that are arranged on the right side extend to the right side from the contact portions 33*c* of the upper electrodes 33.

Note that as illustrated in FIG. 4, the contact portions 33*c* of the upper electrodes 33 are positioned on the diaphragm 30 on the outer side with respect to edges of the pressure chambers 26. Accordingly, a disconnection between the contact portions 33*c* and the traces 35 due to vibration of the diaphragm 30 when the piezoelectric portions 32 are deformed becomes less likely to occur.

As illustrated in FIGS. 2 to 4, a driving contact 40 is provided on the other end of each trace 35 that is on the opposite side with respect to the contact portion 33*c*. The driving contacts 40 are disposed on the insulation film 36 at two left and right end portions of the channel substrate 20 so as to be aligned in the transport direction. As illustrated in FIG. 2, the traces 35 that are drawn out towards the left from the upper electrodes 33 are connected to the driving contacts 40 positioned at the left end portion of the channel substrate 20. The traces 35 that are drawn out towards the right are connected to the driving contacts 40 positioned at the right end portion of the channel substrate 20. Furthermore, ground contacts 41 that are connected through traces (not shown) to the lower electrode 31 that is the common electrode are disposed at the two left and right end portions of the channel substrate 20.

The traces 35 described above are covered by the trace protecting films 37. The trace protecting films 37 are provided with the object to protect the plurality of traces 35 and to ensure insulation between the plurality of traces 35. As illustrated in FIGS. 3 and 4, note that the plurality of driving contacts 40 and the ground contacts 41 are exposed from the trace protecting films 37. The trace protecting films 37 are formed of silicon nitrate (SiNx), for example.

As illustrated in FIG. 2, two chip on films (COFs) 50 that are wiring members are joined to the upper surface of the left end portion and the upper surface of the right end portion of the piezoelectric actuator 22 described above. Furthermore, as illustrated in FIG. 4, a plurality of traces 55 formed in each COF 50 are each electrically connected to the corresponding one of the plurality of driving contacts 40. End portions of each COF 50 on the opposite side of the end portions that are connected to the driving contacts 40 are connected to the controller 6 (see FIG. 1) of the printer 1.

Furthermore, a driver IC 51 is mounted on each COF 50. The driver IC 51 each generate and output a driving signal to drive the corresponding piezoelectric actuator 22 on the basis of a control signal sent from the controller 6. The driving signal output from each driver IC 51 is input to the corresponding driving contact 40 through the trace 55 of the corresponding COF 50 and, further, is supplied to the corresponding upper electrode 33 through the trace 35 of the corresponding piezoelectric actuator 22. A potential of the upper electrode 33 to which the driving signal has been supplied changes between a predetermined drive potential and a ground potential. Furthermore, ground trace (not shown) is also formed in each COF 50 and is electrically connected to the corresponding ground contact 41 of the piezoelectric actuator 22. With the above, the potential of the lower electrode 31 that is connected to the ground contacts 41 is maintained at the ground potential at all times.

Operation of the piezoelectric actuator 22 when a driving signal is supplied from the corresponding driver IC 51 will be described. In a state in which no driving signal is supplied, the potential of the upper electrodes 33 is ground potential, which is the same potential as that of the lower electrode 31. From the above state, when a driving signal is supplied to a certain upper electrode 33 and when a drive potential is applied to the upper electrode 33, due to the potential difference between the upper electrode 33 and the lower electrode 31, an electric field that is parallel to the thickness direction of the piezoelectric portion 32 acts upon the piezoelectric portion 32. In the above, since the direction of polarization of the piezoelectric portion 32 and the direction of the electric field coincides with each other, the piezoelectric portion 32 is stretched in the thickness direction, which is the direction of polarization, and is contracted in the surface direction. Associated with the contraction and deformation of the piezoelectric portion 32, the diaphragm 30 is bent so as to protrude towards the pressure chamber 26 side. With the above, the volume of the pressure chamber 26 is reduced and a pressure wave is generated inside the pressure chamber 26; accordingly, a droplet of ink is ejected from the nozzle 24 that is in communication with the pressure chamber 26.

Reservoir Defining Member

As illustrated in FIG. 4, the reservoir defining member 23 is disposed on the opposite side (the upper side) with respect to the channel substrate 20 with the piezoelectric actuator 22 in between and is joined to the channel substrate 20 through the piezoelectric actuator 22. Similar to the channel substrate 20, the reservoir defining member 23 may be a silicon substrate, for example; however, the reservoir defining member 23 may be a member formed of a metal material or a synthetic resin material.

A reservoir 52 that extends in the arrangement direction (a direction perpendicular to the sheet surface of FIG. 4) of the pressure chambers 26 is formed in an upper half portion of the reservoir defining member 23. Each reservoir 52 is connected to the cartridge holder 7 (see FIG. 1), on which ink cartridges 17 are mounted, by a tube (not shown).

As illustrated in FIG. 4, a plurality of ink supply channels 53 that extended downwards from the reservoir 52 are formed in a lower half portion of the reservoir defining member 23. The ink supply channels 53 are in communication with the plurality of pressure chambers 26 of the channel substrate 20 through the plurality of communication holes 22*a* of the piezoelectric actuator 22 and the plurality of communication holes 30*a* of the diaphragm 30. With the above, ink is supplied to the plurality of pressure chambers 26 from the reservoir 52 through the plurality of ink supply channels 53. Furthermore, a cover portion 54 is formed in the lower half portion of the reservoir defining member 23. A space for housing the plurality of piezoelectric elements 39 of the piezoelectric actuator 22 is formed in the internal space of the cover portion 54.

Note that as illustrated in FIG. 4, the contact portions 33*c* of the upper electrodes 33 are located inside the joined portions between the reservoir defining member 23 and the channel substrate 20 (the piezoelectric actuator 22). In other words, the contact portions 33*c* are positioned at areas covered by the cover portion 54 of the reservoir defining member 23. With the above, since the contact portions 33*c* together with the piezoelectric elements 39 are protected by the cover portion 54, a disconnection between the contact portions 33*c* and the traces 35 becomes less likely to occur.

A manufacturing process of the head units 16 of the inkjet head 4 described above will be described next. FIGS. 6A to 8B are each drawings for describing the manufacturing process of the inkjet head 4.

Figure 6A:
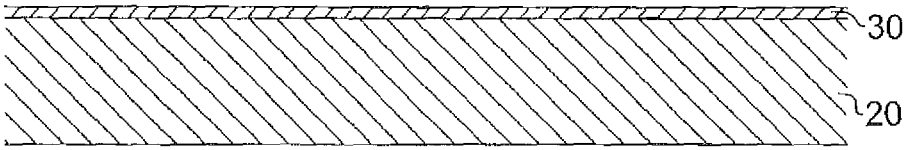
Figure 6B:
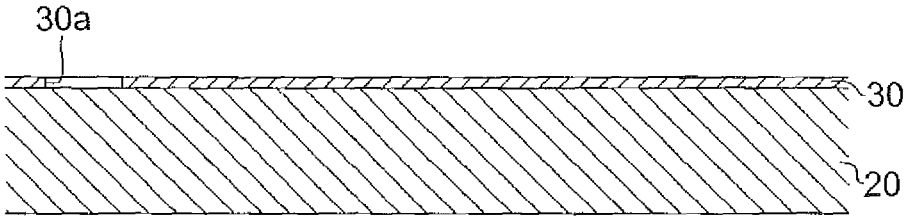
Figure 6C:
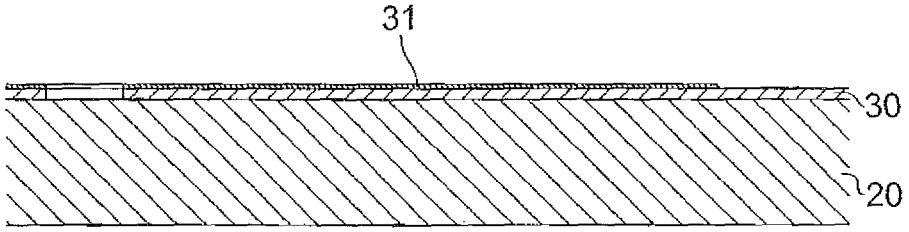
Figure 6D:
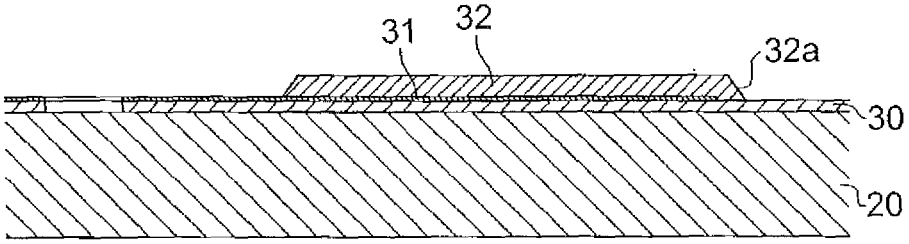
Figure 6E:
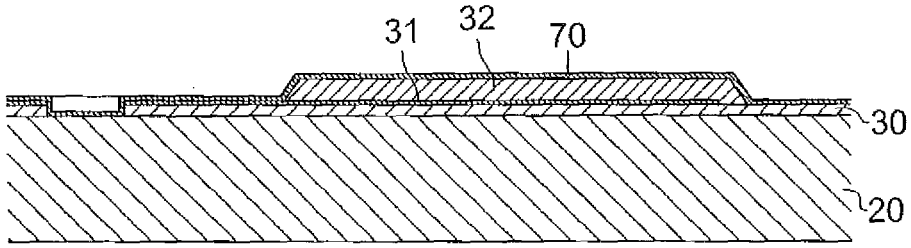
Figure 6F:
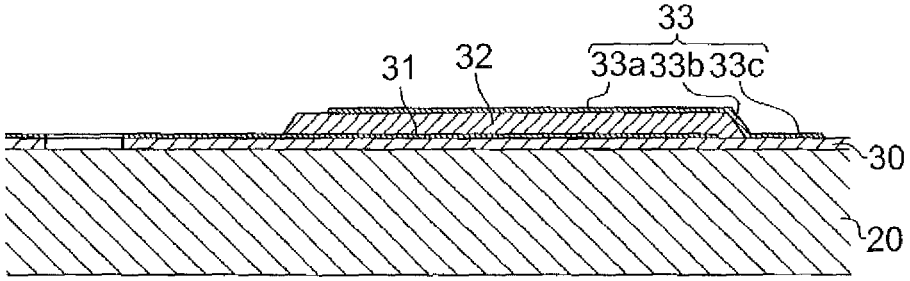

FIGS. 6A to 6F are diagrams illustrating each of the processes in which FIG. 6A illustrates a diaphragm deposition process, FIG. 6B illustrates a diaphragm etching process, FIG. 6C illustrates a lower electrode forming process, FIG. 6D illustrates a piezoelectric portion forming process, FIG. 6E illustrates a deposition process of a conductive film for the upper electrode, and FIG. 6F illustrates an upper electrode patterning process.

In the present exemplary embodiment, the piezoelectric actuator 22 including the plurality of piezoelectric elements 39 are manufactured by repeating, on the diaphragm 30 of the channel substrate 20, a process employing a film deposition method such as sputtering, CVD, or ALD and a patterning process performing etching, such that various films are sequentially stacked.

As illustrated in FIG. 6A, first, the diaphragm 30 formed of silicon dioxide or the like is deposited on the surface of the channel substrate 20 by thermal oxidation or the like. Furthermore, as illustrated in FIG. 6B, the communication holes 30*a* are formed in the diaphragm 30 by etching. Subsequently, as illustrated in FIG. 6C, the lower electrode 31 is formed on the upper surface of the diaphragm 30 by performing film deposition and patterning with a conductive material. Furthermore, as illustrated in FIG. 6D, the piezoelectric portions 32 are formed on the lower electrode 31 by performing film deposition and patterning with a piezoelectric material.

Subsequently, the upper electrodes 33 are formed on the piezoelectric portions 32. As illustrated in FIG. 6E, first, a conductive film 70 is deposited on the upper surface of the diaphragm 30 so as to cover the entire piezoelectric portions 32. Subsequently, as illustrated in FIG. 6F, by etching the conductive film 70, the upper electrodes 33 that include the main electrode portions 33*a*, the lead-out portions 33*b*, and the contact portions 33*c* and that extend from the upper surfaces of the piezoelectric portions 32 to the upper surface of the diaphragm 30 are formed. Note that in FIG. 6D, by forming the lateral surfaces 32*a* of the piezoelectric portions 32 into inclined surfaces, the lead-out portions 33*b* of the upper electrodes 33 can be reliably deposited on the lateral surfaces 32*a* of the piezoelectric portions 32.

Figure 7A:
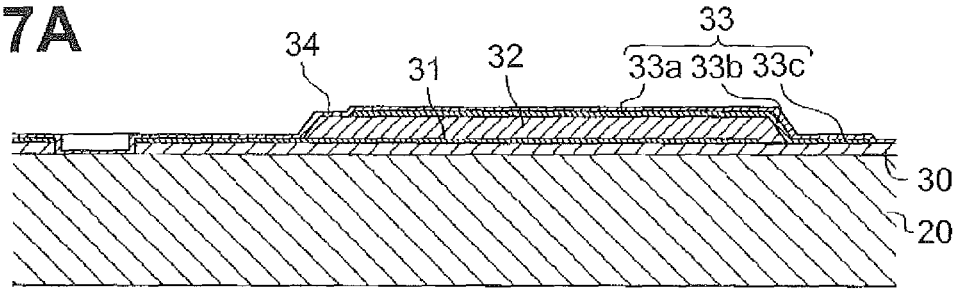
Figure 7B:
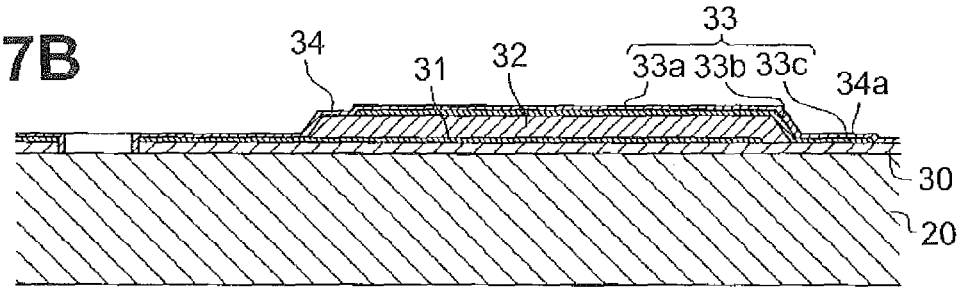
Figure 7C:
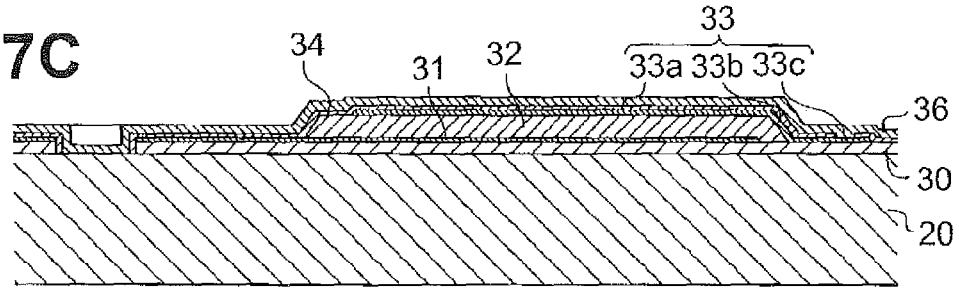
Figure 7D:
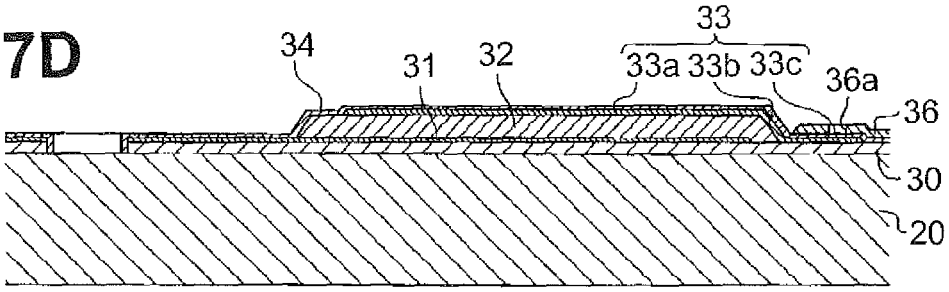

FIGS. 7A to 7D are diagrams illustrating each of the processes in which FIG. 7A illustrates a protective film deposition process, FIG. 7B illustrates a protective film etching process, FIG. 7C illustrates an insulation film deposition process, and FIG. 7D illustrates an insulation film etching process.

As illustrated in FIG. 7A, after depositing the protective film 34 so as to cover the entire piezoelectric portions 32 and upper electrodes 33, as illustrated in FIG. 7B, the protective film 34 is patterned by etching. When patterning the protective film 34, the contact holes 34*a* are formed at portions of the protective film 34 covering the contact portions 33*c* of the upper electrodes 33.

Subsequently, as illustrated in FIG. 7C, after depositing the insulation film 36 on the protective film 34, as illustrated in FIG. 7D, the insulation film 36 is patterned by etching. In the above as well, similar to the patterning of the protective film 34 described above, the contact holes 36*a* are formed at portions of the insulation film 36 covering the contact portions 33*c*. With the above, the contact portions 33*c* of the upper electrodes 33 are exposed from the protective film 34 and the insulation film 36.

Incidentally, the patterning of the protective film 34 and the patterning of the insulation film 36 are desirably performed by wet etching. Although it is possible to pattern the protective film 34 and the insulation film 36 by dry etching, owing to the physical etching action, in dry etching, the upper electrodes 33 under the protective film 34 may be disadvantageously scraped off as well (overetched).

Figure 14:
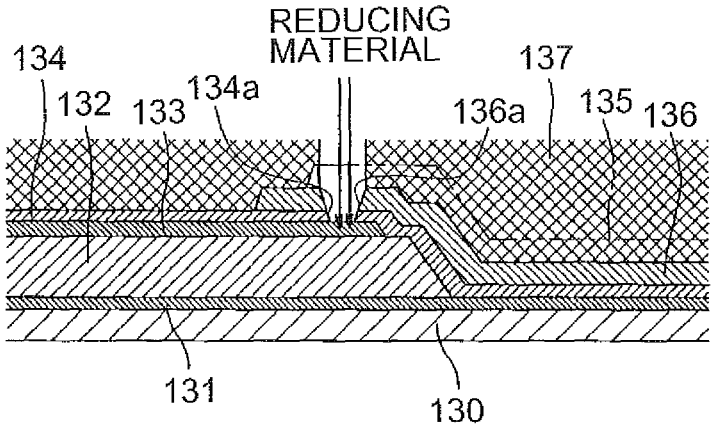
FIG. 14 illustrates a form in which a contact hole is formed in a protective film on an upper surface of a piezoelectric portion and is a diagram for making a comparative description between the present disclosure.

In wet etching, the following etching solutions are typically used. In etching an oxide film, a mixed solution of hydrogen fluoride and ammonium fluoride ($NH_4F$:HF:$H_2O$) or an aqueous hydrogen fluoride solution (HF:$H_2O$) is used. In etching a nitride film, a phosphoric acid solution ($H_3PO_4$:$HNO_3$) is used. When the above etching solutions are used, due to hydrogen included in the etching solution, the piezoelectric portions 32 may be disadvantageously reduced. FIG. 14 illustrates a form in which a contact hole is formed in a protective film on an upper surface of a piezoelectric portion and is a diagram for making a comparative description between the present embodiment. As illustrated in FIG. 14, when an upper electrode 133 and a trace 135 are connected to each other on an upper surface of a piezoelectric portion 132, contact holes 134*a* and 136*a* need to be formed on the upper surface of the piezoelectric portion 132 by wet etching a protective film 134 and an insulation film 136. In the above, even if the upper surface of the piezoelectric portion 132 is covered by the upper electrode 133, the etching solution containing hydrogen may permeate the upper electrode 133 and penetrate into the piezoelectric portion 132 such that, disadvantageously, a portion of the piezoelectric portion 132 is locally reduced.

Due to the reducing action of hydrogen or the like described above, the characteristics of the piezoelectric portion 132 change. Furthermore, as a result of an investigation conducted by the inventors of the present application, it has become known that there is a risk of a dielectric breakdown occurring when a voltage is applied across the upper electrode 133 and a lower electrode 131 and when the electric field concentrates in the portion where the piezoelectric portion 132 has been locally reduced. The mechanism of the above is presumed to be as follows. First, reducing gas reacts with oxygen included in the piezoelectric portion 132 causing an oxygen defect inside the piezoelectric portion 132. By the voltage applied to the piezoelectric portion 132, the defect gradually moves towards the electrode interface and, ultimately, a dielectric breakdown is caused.

In this regard, in the present exemplary embodiment, the upper electrodes 33 are drawn out from the upper surfaces of the piezoelectric portions 32 to the areas of the diaphragm 30 where no piezoelectric portions 32 are disposed. Accordingly, the portions of the protective film 34 that cover the piezoelectric portion 32 do not have to be removed by wet etching to connect the upper electrodes 33 and the traces 35 to each other. Accordingly, when patterning the protective film 34 and the insulation film 36, the piezoelectric portions 32 are always in a state covered by the protective film 34 such that the piezoelectric portions 32 do not receive any damage when wet etching is performed.

Note that in the present exemplary embodiment, the patterning of the protective film 34 and the patterning of the insulation film 36 by etching are performed in different processes; however, the protective film 34 and the insulation film 36 may be patterned at the same time in a single etching process after deposition of the protective film 34 and the insulation film 36.

Figure 8A:
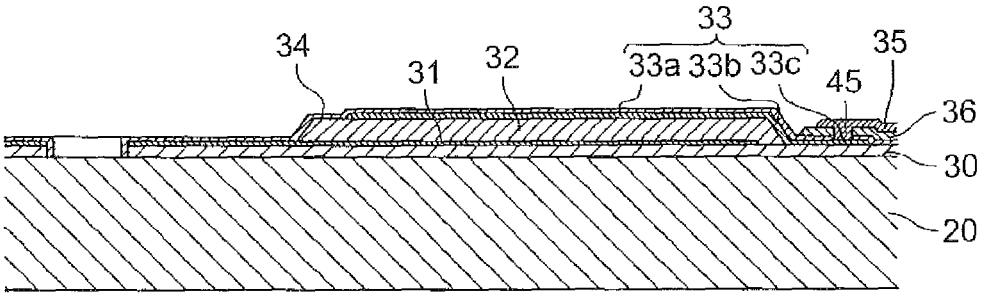
Figure 8B:
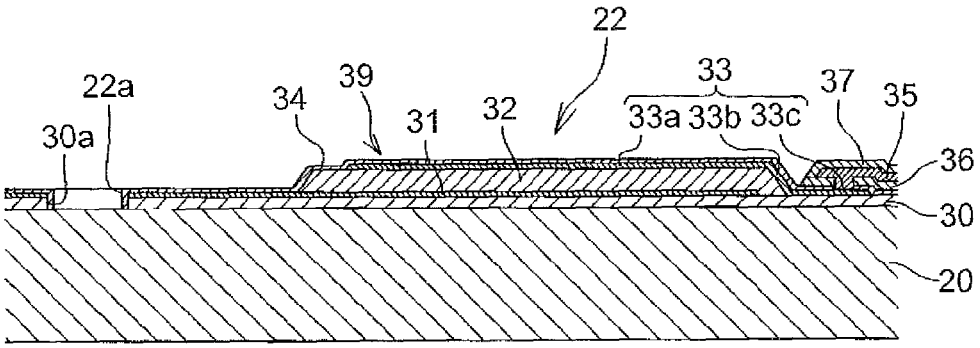

FIGS. 8A and 8B are diagrams illustrating each of the processes in which FIG. 8A illustrates a trace forming process and FIG. 8B illustrates a protective film forming process. As illustrated in FIG. 8A, the traces 35 are formed on the insulation film 36. In other words, after depositing the conductive film so as to cover each of the piezoelectric elements 39, the conductive film is patterned by etching to form the traces 35. When forming the traces 35, a conductive material that constitute the traces 35 is filled in the contact holes 34*a* and 36*a* of the protective film 34 and the insulation film 36, respectively, such that the conduction portions 45 are formed inside the contact holes 34*a* and 36*a*. The contact portions 33*c* of the upper electrodes 33 are connected to the traces 35 with the conduction portions 45. Note that as illustrated above, when forming the traces 35, since the piezoelectric portions 32 are covered with the protective film 34, when patterning the traces 35, the piezoelectric portions 32 do not receive any damage.

Subsequently after the traces 35 are formed, as illustrated in FIG. 8B, trace protecting films 37 are formed so as to cover the traces 35. With the above, the manufacturing of the piezoelectric actuator 22 is completed.

Figure 9A:
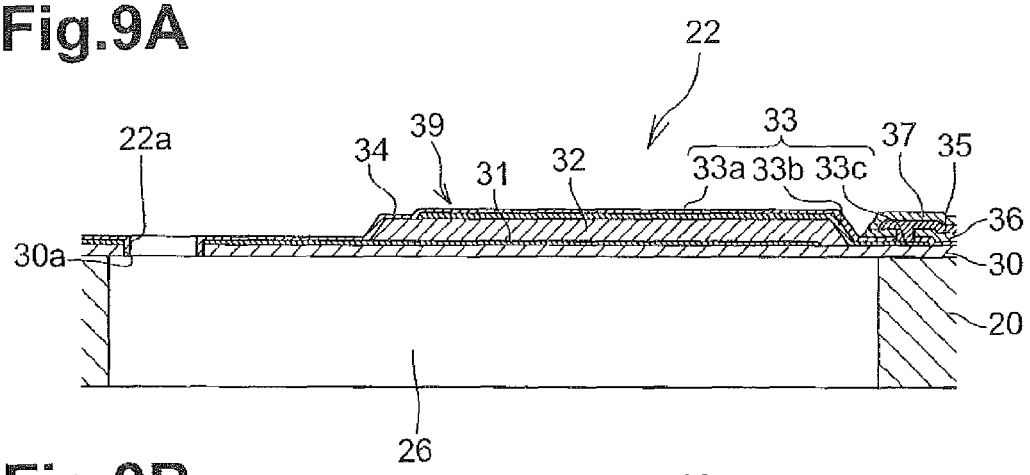
Figure 9B:
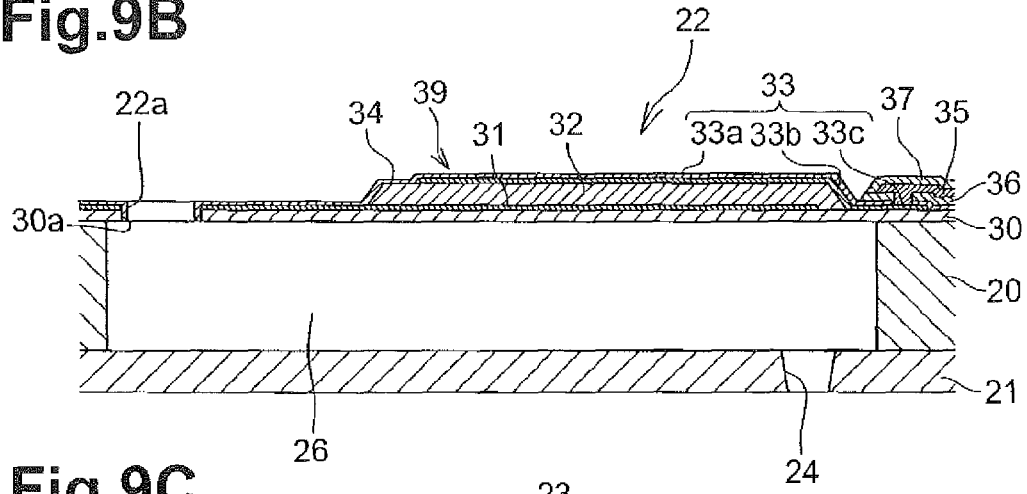
Figure 9C:
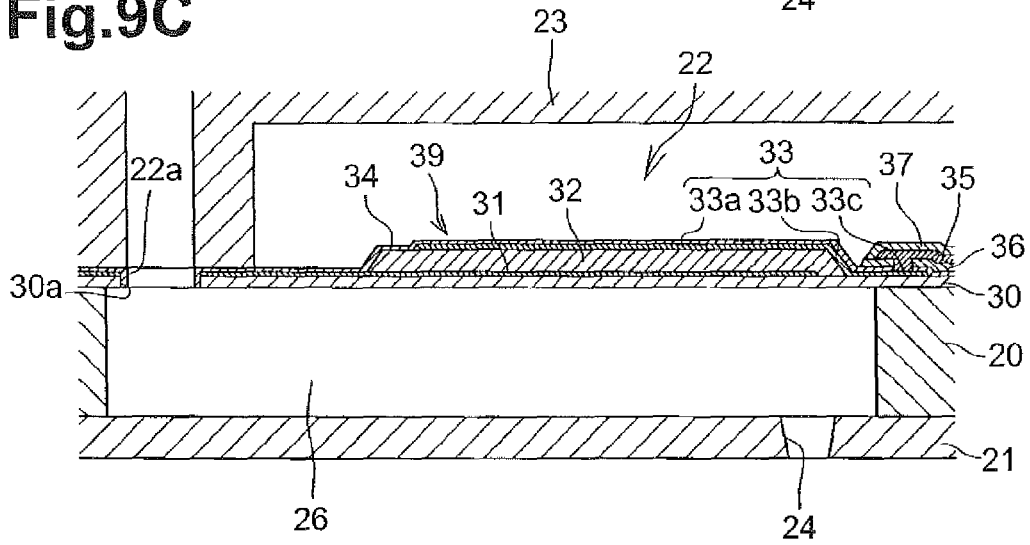

FIGS. 9A to 9C are diagrams illustrating each of the processes in which FIG. 9A illustrates an etching process of the channel substrate, FIG. 9B illustrates a nozzle plate joining process, and FIG. 9C illustrates a reservoir defining member joining process.

As illustrated in FIG. 9A, the pressure chambers 26 are formed by etching the channel substrate 20 from the undersurface side that is the opposite side with respect to the piezoelectric actuator 22. Furthermore, as illustrated in FIG. 9B, the nozzle plate 21 is joined to the undersurface of the channel substrate 20 with an adhesive. Last of all, as illustrated in FIG. 9C, the reservoir defining member 23 is joined to the piezoelectric actuator 22 with an adhesive.

As described above, in the present exemplary embodiment, the lead-out portions 33*b* of the upper electrodes 33 are drawn out from the upper surfaces and along the lateral surfaces of the piezoelectric portions 32 and is further extended to the areas of the diaphragm 30 of the channel substrate 20 where no piezoelectric portions 32 constituted by piezoelectric bodies are disposed. After the above, the contact portions 33*c* of the upper electrodes 33 are exposed from the protective film 34 at areas of the diaphragm 30 in which no piezoelectric portions 32 are disposed, and the traces 35 are connected to the contact portions 33*c*. As described above, since the contact portions 33*c* of the upper electrodes 33 are drawn out to the areas of the diaphragm 30 where no piezoelectric portions 32 are disposed and since the contact portions 33*c* of the upper electrodes 33 are not disposed on the piezoelectric portions 32, when creating contact portions between the upper electrodes 33 and the traces 35, the protective film 34 covering the piezoelectric portions 32 does not need to be removed. Accordingly, during patterning of the protective film 34 or during the following processes such as the process of forming the traces 35, the piezoelectric portions 32 do not receive any damage.

In the exemplary embodiment described above, the inkjet head 4 corresponds to a "liquid ejection apparatus" of the present disclosure. The lower electrode 31 corresponds to a "first electrode" of the present disclosure, and the upper electrode 33 corresponds to a "second electrode" of the present disclosure.

Modifications in which various changes have been made to the exemplary embodiment described above will be described next. However, components that have similar configurations with those of the exemplary embodiment described above are attached with the same reference numerals and descriptions thereof are omitted.

1] In the exemplary embodiment described above, the insulation film 36 for ensuring insulation between the traces 35 connected to the upper electrodes 33, and the lower electrode 31 is formed on the protective film 34; however, if sufficient insulation properties between the traces 35 and the lower electrode 31 can be ensured with only the protective film 34, the insulation film 36 may be omitted.

Figure 10:
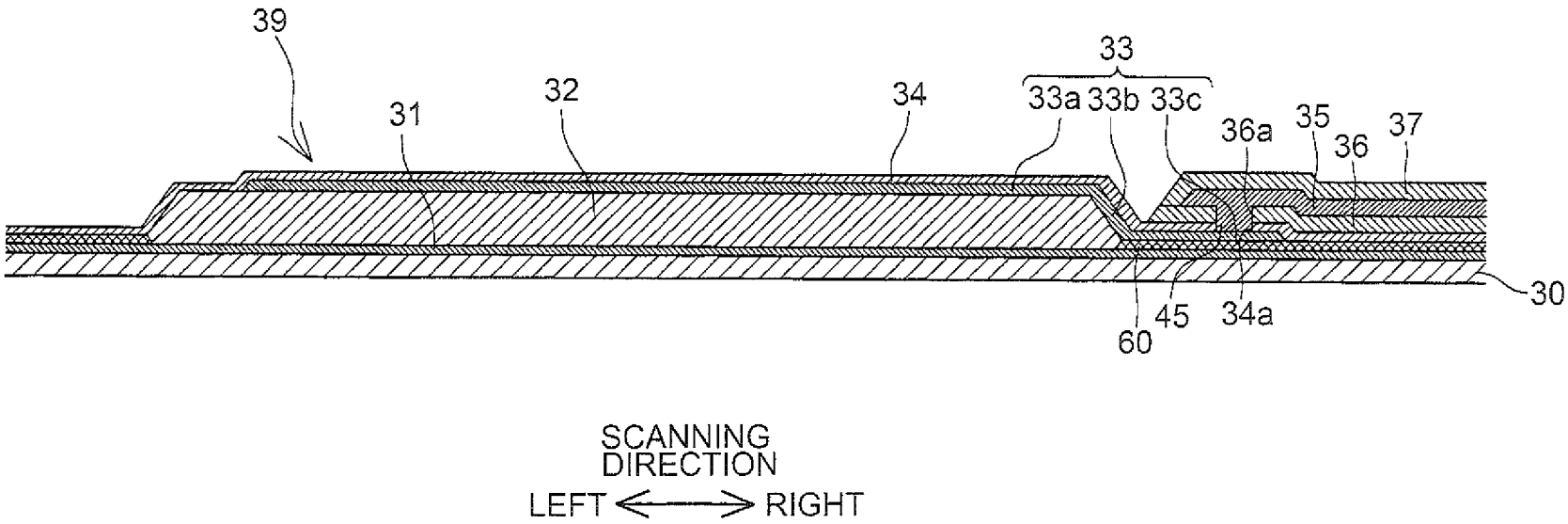
FIG. 10 is a cross-sectional view of a modification of the piezoelectric actuator.

2] As illustrated in FIG. 5, in the exemplary embodiment described above, the hole 31*a* is formed in the lower electrode 31, and the contact portions 33*c* of the upper electrodes 33 that have been drawn out from the upper surfaces of the piezoelectric portions 32 are disposed inside the hole 31*a*. Conversely, as illustrated in FIG. 10 when an insulation film 60 is disposed between the lower electrode 31 and the contact portions 33*c* of the upper electrodes 33, the holes 31*a* for disposing the contact portions 33*c* do not needed to be formed in the lower electrode 31. With the above, the lower electrode 31 can be formed on substantially the entire surface of the diaphragm 30.

Figure 11A:
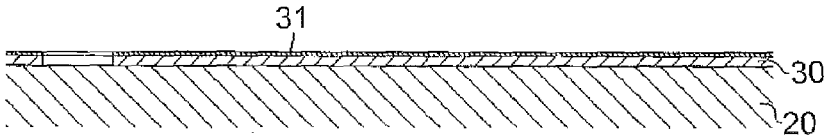
Figure 11B:
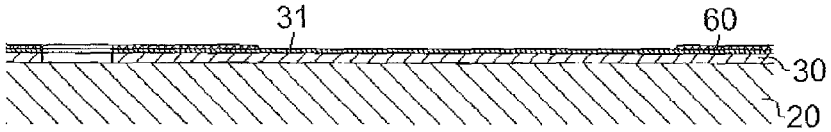
Figure 11C:
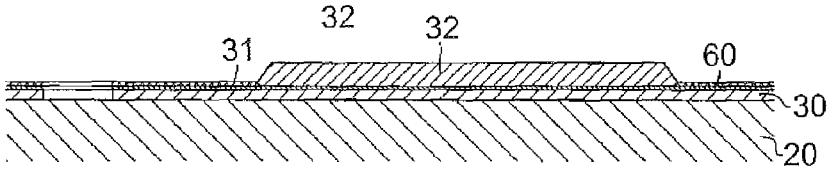

The piezoelectric actuator in FIG. 10 is manufactured in the following manner. As illustrated in FIG. 11A, first, the lower electrode 31 is formed on substantially the entire surface of the diaphragm 30. Subsequently, as illustrated in FIG. 11B, the insulation film 60 is formed by patterning the area where no piezoelectric portions are to be disposed on the lower electrode 31. Then, as illustrated in FIG. 11C, the piezoelectric portions 32 are formed on the lower electrode 31 in the area where no insulation film 60 is covered.

Figure 11D:
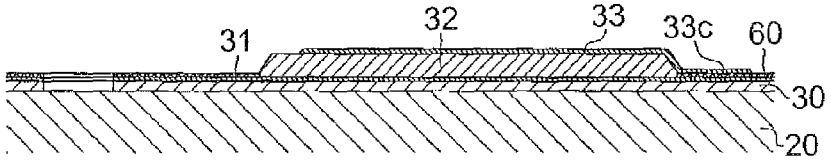
Figure 11E:
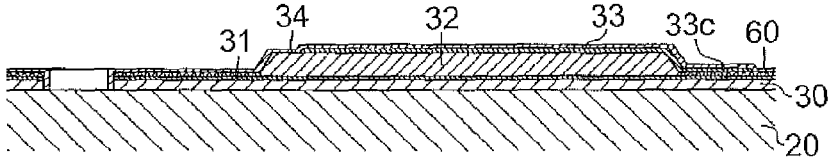
Figure 11F:
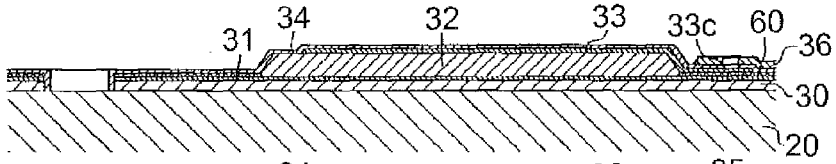
Figure 11G:
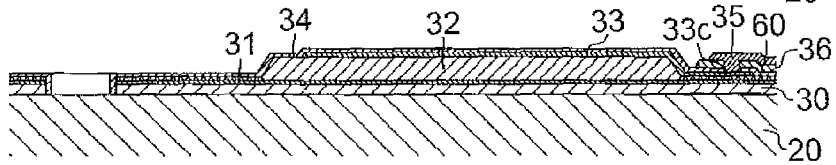
Figure 11H:
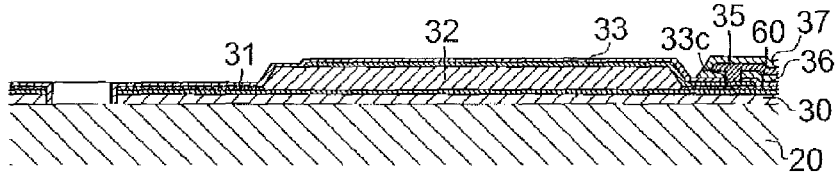

Subsequently, as illustrated in FIG. 11D, the upper electrodes 33 are formed from the upper surfaces of the piezoelectric portions 32 to an upper surface of the insulation film 60. In the above, the contact portions 33*c* of the upper electrodes 33 and the lower electrode 31 are insulated from each other with the insulation film 60. After the above, similar to the exemplary embodiment described above, each of the processes, that is, the forming process of the protective film 34 illustrated in FIG. 11E, the forming process of the insulation film 36 illustrated in FIG. 11F, the forming process of the traces 35 illustrated in FIG. 11G, and the forming process of the trace protecting films 37 illustrated in FIG. 11H, are performed.

Figure 12:
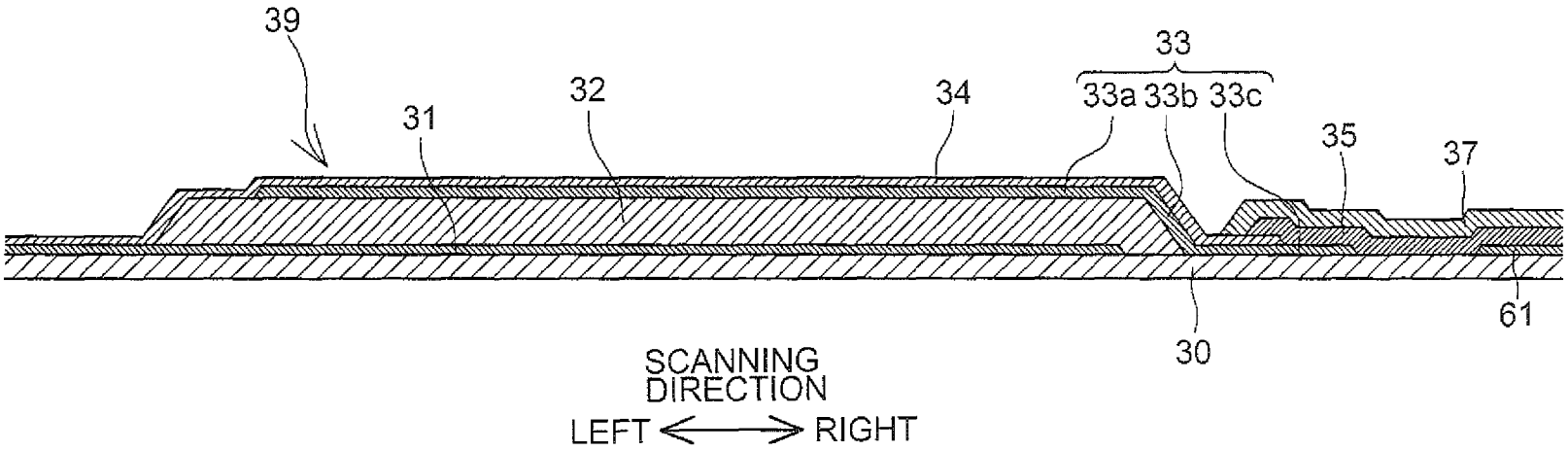
FIG. 12 is a cross-sectional view of another modification of the piezoelectric actuator.

3] As illustrated in FIG. 4, in the exemplary embodiment described above, a portion of the lower electrode 31 is also disposed under the traces 35 that extends to the left or right from the contact portions 33*c* of the upper electrodes 33. Conversely, metal films 61 under the traces 35 may be separated from the lower electrode 31 on the lower side of the piezoelectric portions 32. In such a case as well, the metal films 61 are formed with the same material and the same film deposition process as those of the lower electrode 31. Furthermore, when the metal films 61 are separated from the lower electrode 31, the protective film 34 and the insulation film 36 do not need to be disposed under the traces 35. Accordingly, as illustrated in FIG. 12, each metal film 61 may be disposed so as to be in contact with the corresponding trace 35 after the metal films 61 have been patterned so as to correspond to the plurality of traces 35. When the metal films 61 are overlapped under the traces 35, the substantial thicknesses of the traces 35 becomes larger and the electric resistance of the traces 35 decreases. Furthermore, a disconnection of the traces 35 becomes less likely to occur and the reliability in electrical connection is improved.

Figure 13:
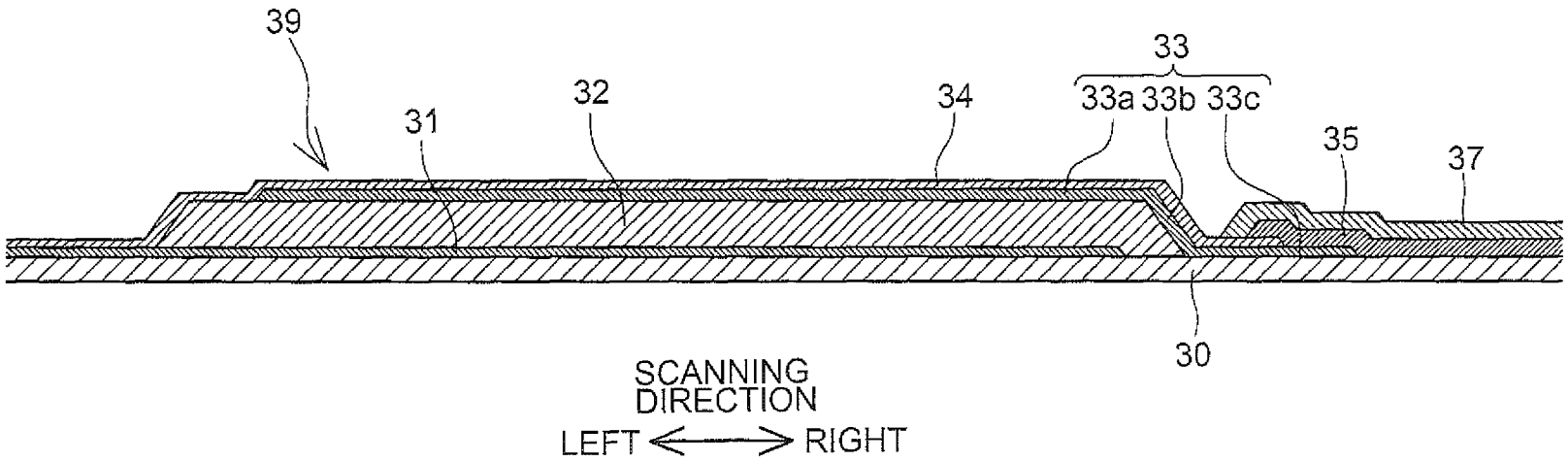
FIG. 13 is a cross-sectional view of still another modification of the piezoelectric actuator.

4] As illustrated in FIG. 13, the lower electrode 31 may not be formed under the traces 35. For example, the above configuration can be realized by drawing out the traces 35 that connect the lower electrode 31 and the ground contacts 41 (see FIG. 2) to each other not in the left or right direction but in the front or rear direction (the direction perpendicular to the sheet surface of FIG. 13). Furthermore, in the above case as well, the protective film 34 and the insulation film 36 do not need to be disposed under the traces 35.

5] In the exemplary embodiment described above, the lower electrode 31 is the common electrode and the upper electrodes 33 are the discrete electrodes; however, opposite to the exemplary embodiment described above, the lower electrode 31 may be the discrete electrode and the upper electrodes 33 may be the common electrode.

6] In the exemplary embodiment described above, the piezoelectric portions 32 of the plurality of piezoelectric elements 39 are configured to be separate from each other; however, the piezoelectric bodies including the plurality of piezoelectric portions 32 may be configured so as to be disposed across the plurality of pressure chambers 26 and the plurality of piezoelectric portions 32 may be connected to each other. In such a case, after the piezoelectric bodies are sequentially disposed along the plurality of pressure chambers 26, the lead-out portions of the upper electrodes are extended from the upper surfaces of the piezoelectric bodies to areas of the channel substrate 20 in which no piezoelectric bodies are disposed. Furthermore, the contact portions of the upper electrodes are disposed to areas of the channel substrate 20 where no piezoelectric bodies are disposed.

7] The structure of the ink channel of the inkjet head 4 is not limited to the structure of the exemplary embodiment described above. For example, the following modification can be made. As illustrated in FIG. 4, in the exemplary embodiment described above, the channel is configured so that ink is supplied to each of the plurality of pressure chambers 26 individually from the reservoir 52 inside the reservoir defining member 23 through the plurality of communication holes 30*a*. Conversely, a channel corresponding to the reservoir 52 may be formed inside the channel substrate 20. For example, a manifold channel that extends in the arrangement direction of the plurality of pressure chambers 26 may be formed inside the channel substrate 20, and in the channel substrate 20, ink may be individually distributed and supplied to the plurality of pressure chambers 26 through the single manifold channel.

The exemplary embodiment and the modifications described above are the present disclosure applied to a piezoelectric actuator of an inkjet head that prints an image and the like by discharging ink onto a piece of recording sheet; however, the present disclosure can also be applied to liquid ejection apparatuses that are used for a variety of purposes other than printing an image and the like. For example, the present disclosure can also be applied to a liquid ejection apparatus that forms a conductive pattern on a surface of a substrate by discharging conductive liquid onto the substrate.

What is claimed is:

1. A liquid ejection apparatus, comprising:

a piezoelectric element corresponding to a pressure chamber in a channel substrate;

a trace corresponding to the piezoelectric element;

the piezoelectric element including:

a piezoelectric layer, a first electrode disposed on a surface of the piezoelectric layer on a channel substrate side, a second electrode disposed on a surface of the piezoelectric layer on a side opposite the channel substrate, and a protective film covering the piezoelectric layer and the second electrode;

the second electrode including:

a lead-out portion that extends from the surface of the piezoelectric layer on the side opposite the channel substrate, along a lateral surface of the piezoelectric layer, and to an area over the channel substrate where the piezoelectric layer is not disposed, and a contact portion that is provided in the lead-out portion and that is exposed from the protective film in the area over the channel substrate where the piezoelectric layer is not disposed; and the trace being connected to the second electrode at the exposed contact portion.

2. The liquid ejection apparatus according to claim 1, further comprising:

a plurality of piezoelectric elements corresponding to a plurality of pressure chambers in the channel substrate; and a plurality of traces corresponding to the plurality of piezoelectric elements.

3. The liquid ejection apparatus according to claim 2, further comprising a diaphragm that covers the plurality of pressure chambers.

4. The liquid ejection apparatus according to claim 1, further comprising a diaphragm that covers the pressure chamber.

5. The liquid ejection apparatus according to claim 1, wherein the second electrode includes a main electrode portion disposed on the surface of the piezoelectric layer on the side opposite the channel substrate, wherein the main portion, the lead-out portion, and the contact portion reside in the same layer.

6. The liquid ejection apparatus according to claim 1, wherein the lateral surface of the piezoelectric layer on which the lead-out portion is provided is an inclined surface, wherein the inclined surface and the surface of the piezoelectric layer on the channel substrate side form an acute angle.

7. The liquid ejection apparatus according to claim 6, wherein the inclined surface and the surface of the piezoelectric layer on the channel substrate side are oriented at a 45 degree to 60 degree angle to each other.

8. The liquid ejection apparatus according to claim 6, wherein an end of the first electrode in a first direction, the first direction being a direction in which the lead-out portion of the second electrode extends from the piezoelectric layer, does not overlap the lateral surface of the piezoelectric layer in a thickness direction of the piezoelectric layer.

9. The liquid ejection apparatus according to claim 8, wherein an end of the second electrode in a second direction, the second direction being a direction opposite to the first direction, is positioned inside an end of the piezoelectric layer in the second direction and inside an end of the first electrode in the second direction.

10. The liquid ejection apparatus according to claim 1, wherein the contact portion is positioned over the channel substrate outside of a location that includes the pressure chamber.

11. The liquid ejection apparatus according to claim 1, further comprising:

a cover joined to the channel substrate and having a space to accommodate the piezoelectric element, wherein the contact portion is disposed inside the space covered by the cover member.

12. The liquid ejection apparatus according to claim 11, wherein the cover is included in a reservoir defining member.

13. The liquid ejection apparatus according to claim 1, further comprising:

a metal film that is on a lower side of the trace, the metal film being of a same material as that of the first electrode.

14. The liquid ejection apparatus according to claim 13, wherein the metal film is in contact with the trace.

15. A method for manufacturing a liquid ejection apparatus, comprising:

forming a first electrode;

forming a piezoelectric layer on the first electrode;

forming a second electrode on a surface of the piezoelectric layer on a side opposite a channel substrate, the second electrode including a lead-out portion extending from the surface of the piezoelectric layer along a lateral surface of the piezoelectric layer, and a contact portion positioned on an area over the channel substrate on which the piezoelectric layer is not disposed;

forming a protective film covering the piezoelectric layer and the second electrode to cover an entirety of the second electrode including the lead-out portion and the contact portion;

wet etching the protective film to expose a portion of the contact portion of the second electrode; and forming a trace that is connected to the second electrode exposed from the protective film by the wet etching.

* * * * *